US006079960A

United States Patent [19]

Funatsu et al.

[11] Patent Number: 6,079,960

[45] Date of Patent: Jun. 27, 2000

[54] LINEAR COMPRESSOR WITH A COAXIAL PISTON ARRANGEMENT

[75] Inventors: Yoshinori Funatsu, Anjo; Nobuo Okumura, Toyota, both of Japan

[73] Assignee: Aisin Seiki Kabushiki Kaisha, Aichi-Pref., Japan

[21] Appl. No.: 09/086,708

[22] Filed: May 29, 1998

[30] Foreign Application Priority Data

May 29, 1997 [JP] Japan ..... 9-140569

[51] Int. Cl.[7] ..... F25B 9/00

[52] U.S. Cl. ..... 417/488; 417/313; 62/6

[58] Field of Search ..... 417/488, 313; 62/6

[56] References Cited

U.S. PATENT DOCUMENTS

| | | | |
|---|---|---|---|
| 3,220,201 | 11/1965 | Heuchling | 62/6 |
| 3,788,088 | 1/1974 | Dehne | 62/6 |
| 4,010,621 | 3/1977 | Raetz | 62/6 |
| 4,872,313 | 10/1989 | Kazumoto et al. | 62/6 |
| 5,113,662 | 5/1992 | Fujii et al. | 62/6 |
| 5,174,130 | 12/1992 | Lucas | 62/498 |
| 5,465,579 | 11/1995 | Terada et al. | 62/6 |
| 5,609,034 | 3/1997 | Mita et al. | 62/6 |
| 5,693,991 | 12/1997 | Hiterer et al. | 310/30 |

FOREIGN PATENT DOCUMENTS

| | | |
|---|---|---|
| 1-46543 | 2/1989 | Japan . |
| 7-88986 | 9/1995 | Japan . |

*Primary Examiner*—Charles G. Freay
*Assistant Examiner*—Robert Z. Evora
*Attorney, Agent, or Firm*—Reed Smith Hazel & Thomas LLP

[57] ABSTRACT

A linear compressor having improved heat-radiating performance incorporates first and second cylinders disposed coaxially, a first piston reciprocatably disposed inside the first cylinder, a second piston reciprocatably disposed inside the second cylinder, a compression chamber formed by the front face of the first piston and the front face of the second piston and a connecting wall connecting the first and second cylinders, and multiple working gas passages having openings formed in the connecting wall and connecting the compression chamber to the outside via these openings. The working gas passages are formed on a plane perpendicular to the axial direction of the first and second cylinder. Heat-radiating means are provided around the working gas passages. The first cylinder and the second cylinder are made of aluminum (or an aluminum alloy). As a result, the size of the compression chamber can he decreased and the compression ratio thereby increased, and heat from the working gas can be radiated efficiently from the working gas passages and from the cylinders.

3 Claims, 4 Drawing Sheets

LINEAR COMPRESSOR WITH A COAXIAL PISTON ARRANGEMENT

FIELD OF THE INVENTION

This invention relates to a linear compressor, and to technology for effectively radiating heat when a gas is compressed in a compressor of this kind.

BACKGROUND OF THE INVENTION

Refrigerators such as Stirling refrigerators and pulse pipe refrigerators require a pressure fluctuation source for creating pressure fluctuation in a refrigerating fluid inside the refrigerator. In recent years, linear compressors have been receiving attention as an instrument for providing such pressure fluctuations. A linear compressor of this kind is disclosed in Japanese Patent Publication No. H,7-88986, which will now be described on the basis of FIG. 4.

FIG. 4 shows an example of a linear compressor applied to a Stirling refrigerator. In the figure, a Stirling refrigerator 70 is basically made up of a compressor 71, a cold finger 72 and a connecting pipe 73 connecting these together. Of these, the compressor 71 has a first cylinder 73*a* and a first piston 74*a* and a second cylinder 73*b* and a second piston 74*b*, contained inside a housing 71*a*. A partition wall 75 is disposes between the first cylinder 73*a* and the second cylinder 73*b*. The first piston 74*a* and the second piston 74*b* are positioned by support springs 76*a*, 76*b*, respectively, and reciprocate, respectively, inside the first cylinder 73*a* and the second cylinder 73*b*.

Lightweight first and second sleeves 77*a* and 77*b* made of a non-magnetic material are connected to the first piston 74*a* and the second piston 74*b*, respectively, and conductors are wound around these sleeves to form a first moving coil 78*a* and a second moving coil 78*b*. Permanent magnets 79*a*, 79*b* and yokes 80*a*, 80*b* are also provided inside the housing 71*a* and together these constitute a magnetic circuit.

In this construction, when a sine wave current is passed through the first moving coil 78*a* and the second moving coil 78*b* so that they vibrate with the same amplitude in mutually opposite directions, the two pistons 74*a*, 74*b* reciprocate inside the cylinders 73*a*, 73*b* in opposite directions and impart a sine wave motion to a gas pressure inside the working space between them. Flow changes of gas passing through a displacer 82 and a regenerator 83 accompanying this sine wave gas wave motion cause the displacer 82 containing the regenerator 83 to reciprocate axially inside the cold finger 72 at the same frequency as the pistons 74*a*, 74*b* but with a different phase.

When the pistons 74*a*, 74*b* and the displacer 82 move while maintaining a suitable phase difference, the working gas sealed inside the working space goes through a known thermodynamic cycle called the reverse Stirling cycle, and removes heat mainly from a low-temperature chamber 81 of the cold finger 72.

In the linear compressor of the related device described above, opposing pistons are used; however, with this kind of construction, because the compression space, which reaches high temperatures and high pressures, formed between the pistons is positioned in the approximate center of the compressor, it is difficult for heat produced in the compression space to be radiated to the outside. Consequently, there has been the problem that the temperature of the working gas is raised by heat produced in the compression space and the refrigerating capacity of the refrigerator deteriorates.

SUMMARY OF THE INVENTION

The present invention provides a linear compressor having improved heat-radiating performance.

This invention provides a linear compressor comprising first and second cylinders disposed coaxially, a first piston reciprocatably disposed inside the first cylinder, a second piston reciprocatably disposed inside the second cylinder, a compression chamber formed by the front face of the first piston and the front face of the second piston and a connecting wall connecting the first and second cylinders, and multiple working gas passages having openings formed in the connecting wall and connecting the compression chamber to the outside via these openings, the working gas passages being formed in a plane perpendicular to the axial direction of the first and second cylinders.

According to the invention, working gas compressed by the reciprocating action of the pistons is delivered to the outside through these multiple working gas passages.

Because the working gas, which is brought to a high temperature and pressure by the reciprocating action of the pistons, is delivered to the outside through multiple working gas passages, the area of contact between the working gas passing through these multiple working gas passages and the passage walls is larger than when there is only one working gas passage. Consequently, as the working gas passes through the working gas passages, a lot of the heat from the working gas is transferred to the working gas passage walls, with the result that the compressor radiates heat efficiently.

Corresponding to the arrangement of the multiple working gas passages formed in a plane perpendicular to the axial direction of the cylinders, the openings formed in the wall of the compression chamber are also formed in a plane perpendicular to the axial direction of the cylinder. Because the openings in the compression chamber are formed in this way, the minimum width (length in the cylinder axial direction) of the compression chamber that must be provided is approximately the width of one of the openings formed in the wall of the compression chamber. Since the compression chamber can thus be made relatively small, the compression ratio of the compressed working gas can be made relatively large and the compression efficiency can thereby be increased.

The preferred embodiment of this invention also incorporates heat-radiating means that is provided around the working gas passage. With the addition of the heat-radiating means, heat from hot working gas is released to the outside by the heat-radiating means. By this means, it is possible to provide a linear compressor having increased heat-radiating efficiency.

The preferred embodiment of this invention also provides that the first cylinder and the second cylinder are made of aluminum or an aluminum alloy. When this construction is employed, because the first cylinder and the second cylinder are made of aluminum or an aluminum alloy, since aluminum has good thermal conductivity, heat from hot working gas inside the compression chamber is efficiently radiated to the outside through the first cylinder and the second cylinder.

In the second preferred embodiment of this invention, a first embodiment of this invention is applied to a Stirling refrigerator, which consists of a housing, a displacer supported by a spring filled with a cold storage material, an expansion chamber, a refrigerating side compression chamber and a conduit which connects the refrigerating side compression chamber to the working gas passages of the linear compressor. Under the pressure fluctuation transmitted through the conduit, the displacer reciprocates with a fixed phase difference with respect to such fluctuation. In this second embodiment of the present invention, the refrigerating efficiency of the Stirling refrigerator is very high.

DETAILED DESCRIPTION OF THE PROPOSED EMBODIMENTS

Preferred embodiments of the invention will now be described on the basis of the accompanying drawings

First Preferred Embodiment

Figure 1:
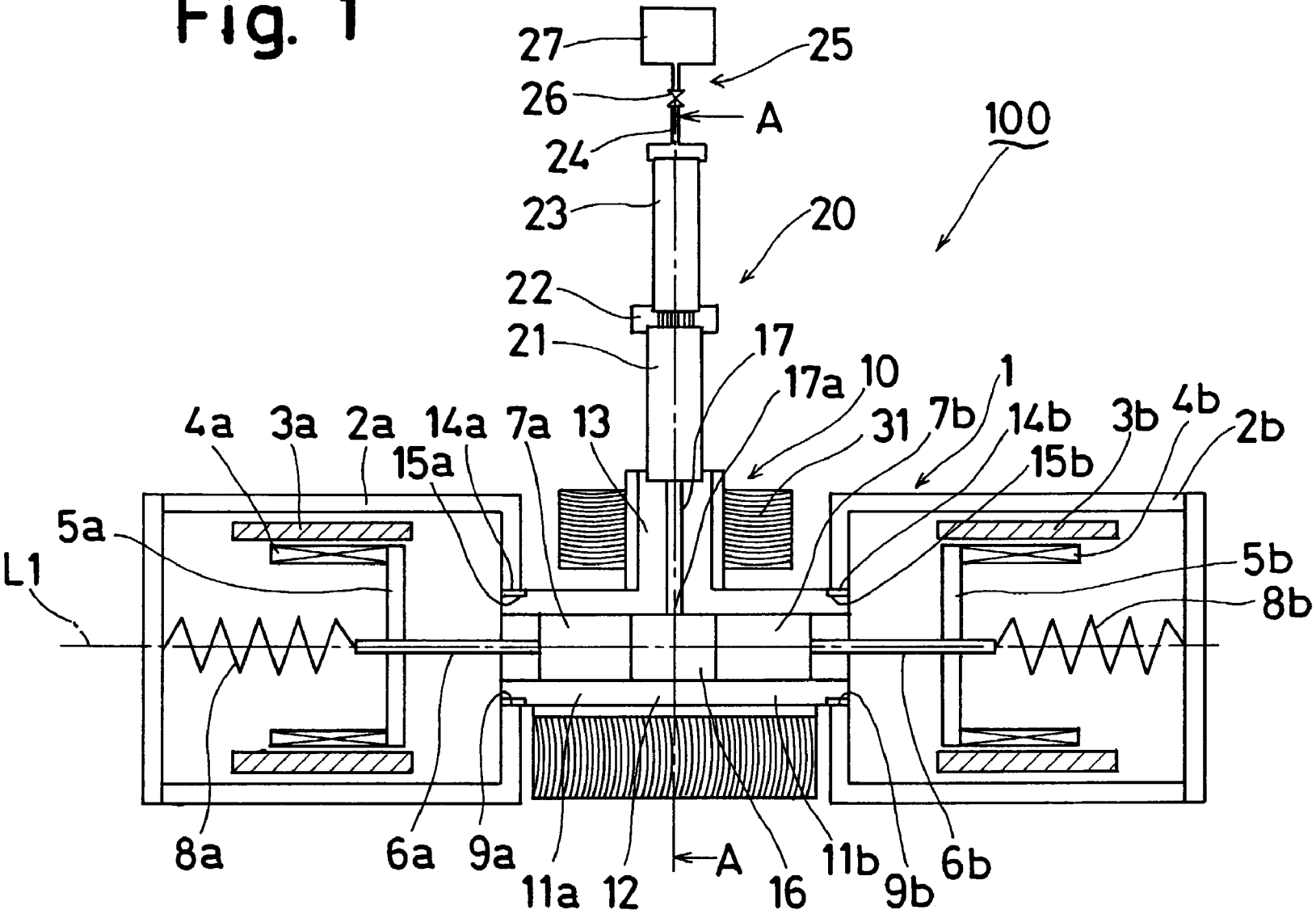
FIG. 1 is a view showing a first preferred embodiment of the invention, wherein a linear compressor according to the invention is applied as a pressure variation source of a pulse pipe refrigerator.

FIG. 1 is a view of a linear compressor of the first preferred embodiment of the present invention.

In the figure, a linear compressor 1 has stainless steel first and second cases 2*a* and 2*b*. A cylindrical permanent magnet 3*a* is mounted inside the first case 2*a*. A moving coil 4*a* is disposed around the inside of the permanent magnet 3*a* substantially coaxially with the cylinder axis (the axis L1 in the figure) of the permanent magnet 3*a*. The moving coil 4*a* is so disposed that there is a gap of a predetermined size between the moving coil 4*a* and the permanent magnet 3*a*. A disc-shaped moving member 5*a* is connected to the front end (the right side end in the figure) of the moving coil 4*a*. A rod 6*a* is connected to the center of the moving member 5*a*. The rod 6*a* is connected at its front end (the right side end in the figure) to the rear face of a first piston 7*a* and is connected at its rear end (the left side end in the figure) to one end of a spring 8*a*. The other end of the spring 8*a* is connected to the rear end wall (the left side wall in the figure) of the first case 2*a*.

The construction inside the second case 2*b* is the same as the construction inside the first case 2*a*. That is, a cylindrical permanent magnet 3*b* is mounted inside the second case 2*b*. A moving coil 4*b* is disposed around the inside of the permanent magnet 3*b* substantially coaxially with the cylinder axis (the axis L1) of the permanent magnet 3*b*. The moving coil 4*b* is so disposed that there is a gap of a predetermined size between the moving coil 4*b* and the permanent magnet 3*b*. A disc-shaped moving member 5*b* is connected to the front end (the left side end in the figure) of the moving coil 4*b*. A rod 6*b* is connected to the center of the moving member 5*b*. The rod 6*b* is connected at its front end (the left side end in the figure) to the rear face of a second piston 7*b* and is connected at its rear end (the right side end in the figure) to one end of a spring 8*b*. The other end of the spring 8*b* is connected to the rear end wall (the right side wall in the figure) of the second case 2*b*.

A circular opening 9*a* is formed in the front end wall (the right side wall in the figure) of the first case 2*a*. Similarly, a circular opening 9*b* is formed in the front end wall (the left side wall in the figure) of the second case 2*b*. The opening 9*a* and the opening 9*b* are of the same diameter and are formed with their centers on the axis L1.

An aluminum or aluminum alloy cylinder member 10 consists of a first cylinder part 11*a* receiving the first piston 7*a*, a second cylinder part 11*b* receiving the second piston 7*b*, a connecting wall part 12 connecting the first cylinder part 11*a* and the second cylinder part 11*b*; and a working gas passage part 13; one end of the first cylinder part 11*a* is fitted in the opening 9*a* of the first case 2*a* with a stainless steel ring 14*a* therebetween, and one end of the second cylinder part 11*b* is fitted in the opening 9*b* of the second case 2*b* with a stainless steel ring 14*b* therebetween. Here, the method by which the cases are connected to the cylinder member is that first the ring 14*a* is fitted onto a step part 15*a* of the first cylinder part 11*a* and the ring 14*b* is fitted onto a step part 15*b* of the second cylinder part 11*b*. The opening 9*a* of the first case 2*a* is fitted onto the outside of the ring 14*a* and the opening 9*b* of the second case 2*b* is fitted onto the outside of the ring 14*b* and the cases are rotated so that the cases and the cylinder member 10 are joined by frictional bonding. In this case, because the parts being frictionally bonded together are stainless steel cases and stainless steel rings, they can be frictionally bonded easily.

In this case, if the aluminum cylinder member 10 and the stainless steel first and second cases 2*a*, 2*b* were to be joined directly, because their materials are different, a good joint strength could not be obtained. However, in this preferred embodiment, because stainless steel rings 14*a*, 14*b* are fitted to the parts of the aluminum cylinder member 10 that are to be joined to the cases 2*a*, 2*b* and these rings 14*a*, 14*b* are then joined to the cases 2*a*, 2*b*, the subject joints become joints between parts made of the same material and consequently a good joint strength is obtained.

The first cylinder part 11*a* and the second cylinder part 11*b* are disposed coaxially on the axis L1. Consequently, the first piston 7*a* reciprocates in the first cylinder part 11*a* and the second piston 7*b* reciprocates in the second cylinder part 11*b*, and both pistons reciprocate coaxially on the axis L1. The front face of the first piston 7*a*, the front face of the second piston 7*b* and the connecting wall part 12 form a compression chamber 16 for compressing the working gas. Working gas passages 17 are formed inside the working gas passage part 13, and these working gas passages 17 each have one end opening 17*a* at the connecting wall part 12, and the other end connected to a refrigerating part 20 discussed below.

The refrigerating part 20 consists mainly of a cold storer 21 connected to the working gas passages 17 and filled with a cold storage material, a cold head 22 for cooling connected to the cold storer 21, a pulse pipe 23 made from a hollow stainless steel pipe and connected to the cold head 22, and a phase adjusting mechanism 25, connected to the pulse pipe 23 by way of a connecting pipe 24. The phase adjusting mechanism 25 adjusts the phase difference between pressure fluctuations and displacement fluctuations of the working gas. In this example, an orifice 26 and a buffer tank 27 are used as the phase adjusting mechanism 25. The linear compressor 1 and the refrigerating part 20 described above make up a pulse pipe refrigerator.

Figure 2:
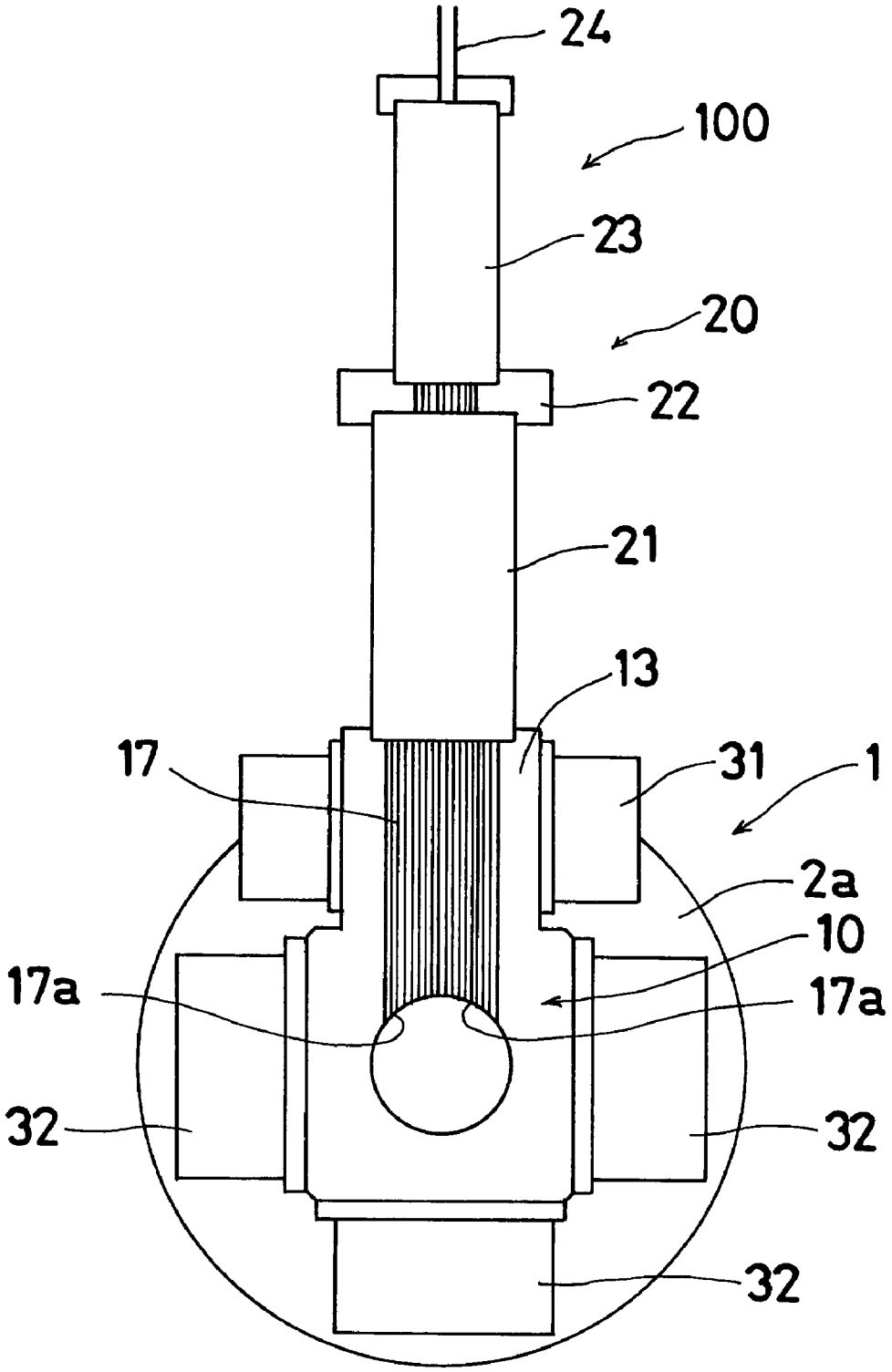
FIG. 2 is a cross-sectional view on the line A—A in FIG. 1.

FIG. 2 is a cross-sectional view taken on the line A—A in FIG. 1. As is clear from FIG. 1 and FIG. 2, radiating fins 31 serving as radiators are mounted around the working gas passage part 13. And, as is clear from FIG. 2, radiating fins 32 are also mounted on the bottom and left and right parts in the figure of the cylinder member 10.

The working gas passages 17 formed in the working gas passage part 13 are formed in a plane perpendicular to the axis L1 in FIG. 1, that is, in the plane of the paper of FIG. 2. The working gas passages 17 are each individually connected to the cold storer 21.

In this embodiment of the present invention, when an alternating current is passed through the moving coils 4*a*, 4*b*, the first piston 7*a* and the second piston 7*b* reciprocate in opposite directions in the first cylinder part 11*a* and the second cylinder part 11*b* along the axis L1, and impart a sine wave motion to the gas pressure inside the compression chamber 16. This pressure fluctuation is transmitted through the working gas passages 17 to the cold storer 21, the cold head 22 and the pulse pipe 23. At this time, as a result of the action of the phase adjusting mechanism 25 (made up of the orifice 26 and the buffer tank 27), a predetermined phase difference arises between the displacement fluctuation and the pressure fluctuation mainly of the working gas inside the cold storer 21. When this phase difference is suitably adjusted, in the vicinity of the cold head 22, the working gas expands and takes in heat, and in the part of the cold storer 21 near the working gas passages 17, the working gas is compressed and releases heat. That is, there is an action like heat being pumped from the vicinity of the cold head 22 to the side of the cold storer 21 near the working gas passages 17. By this means, a refrigerating action is obtained in the vicinity of the cold head 22.

In the working gas passages 17, because the working gas (which has been heated to a relatively high temperature by the compressing action of the linear compressor) is transported to the refrigerating part 20, and also because heat in the vicinity of the cold head 22 is pumped out to the working gas passage 17 side, heat tends to accumulates in this part. However, because multiple working gas passages 17 are disposed in a line and the contact area between the working gas and the working gas passage walls is relatively large, this heat is rapidly transferred to the passage walls and heat accumulating in the working gas is thereby removed. Because the construction of the linear compressor of this preferred embodiment is such that heat accumulating in the working gas can be rapidly removed in this way, the working gas does not reach a high temperature and the refrigerating efficiency of the refrigerator is increased.

And, in this preferred embodiment, because the radiating fins 31 are provided around the working gas passage part 13, heat transmitted to the working gas passage part 13 from the working gas passages 17 is radiated rapidly to the outside through the radiating fins 31. Because the linear compressor in this preferred embodiment is of a construction such that heat accumulating in the working gas passage part 13 can be rapidly dissipated in this way, its heat-radiating performance and the refrigerating efficiency are further increased.

Also, in this preferred embodiment, because the radiating fins 32 are provided around the cylinder member 10, i.e., on the bottom face and the left and right faces of the cylinder member 10 in FIG. 2, compression heat produced inside the compression chamber 16 can be radiated to the outside directly, which also increases the heatradiating performance and refrigerating efficiency.

Additionally, in this preferred embodiment, because the cylinder member 10 is made of aluminum (or an aluminum alloy), which material has good thermal conductivity, heat from the working gas inside the compression chamber 16 and the working gas passages 17 is also rapidly transferred to the cylinder member 10. Consequently, the heat-radiating performance is increased even more.

Second Preferred Embodiment

Next, a second preferred embodiment of the invention will be described on the basis of FIG. 3. In this preferred embodiment, a linear compressor according to the invention is applied as a pressure variation source of a Stirling refrigerator, and the detailed construction of the linear compressor is the same as that of the first preferred embodiment. Accordingly, the following description will center on points of difference between this second preferred embodiment and the first preferred embodiment.

Figure 3:
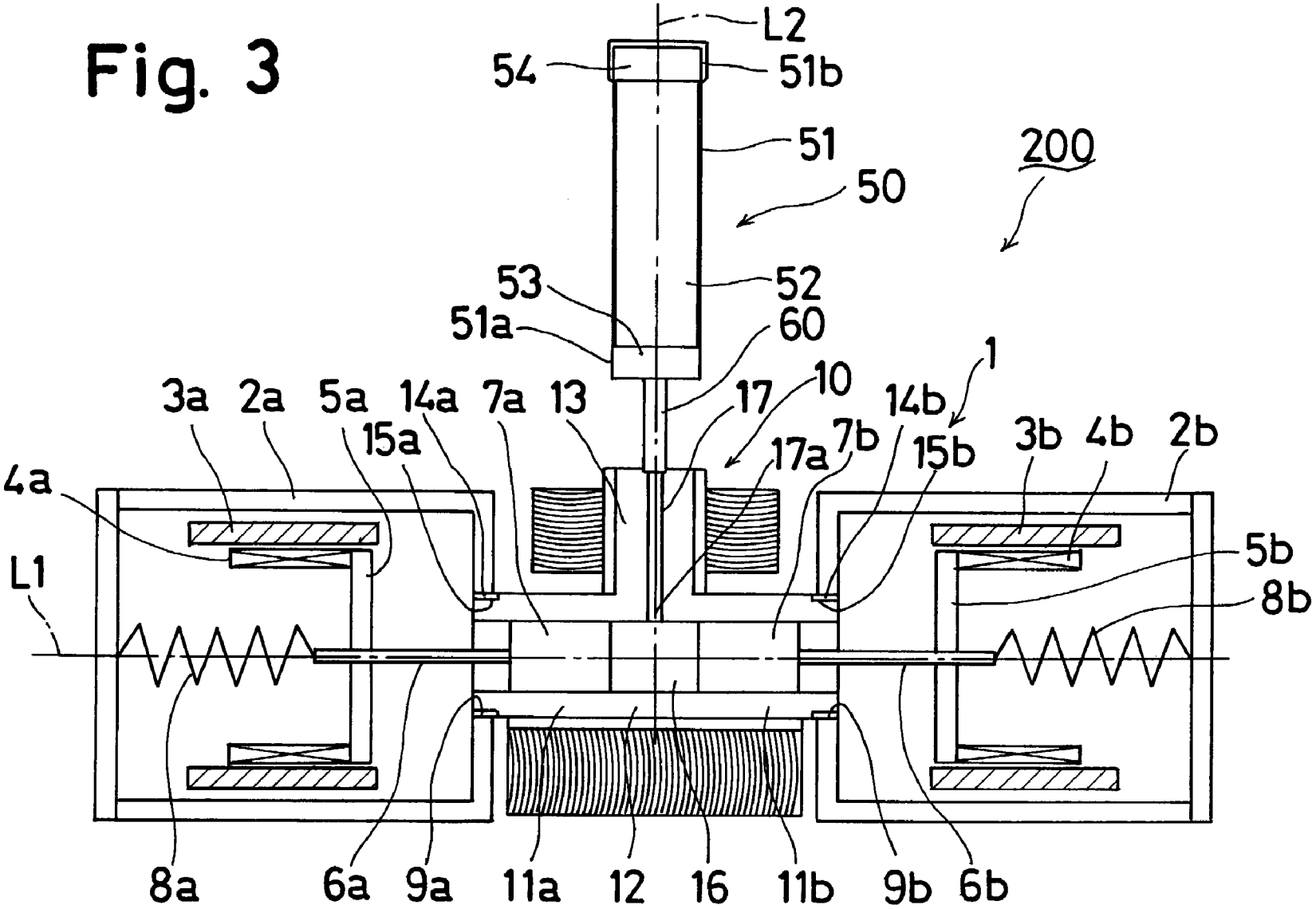
FIG. 3 is a view showing a second preferred embodiment of the invention, wherein a linear compressor according to the invention is applied as a pressure variation source of a Stirling refrigerator.
Figure 4:
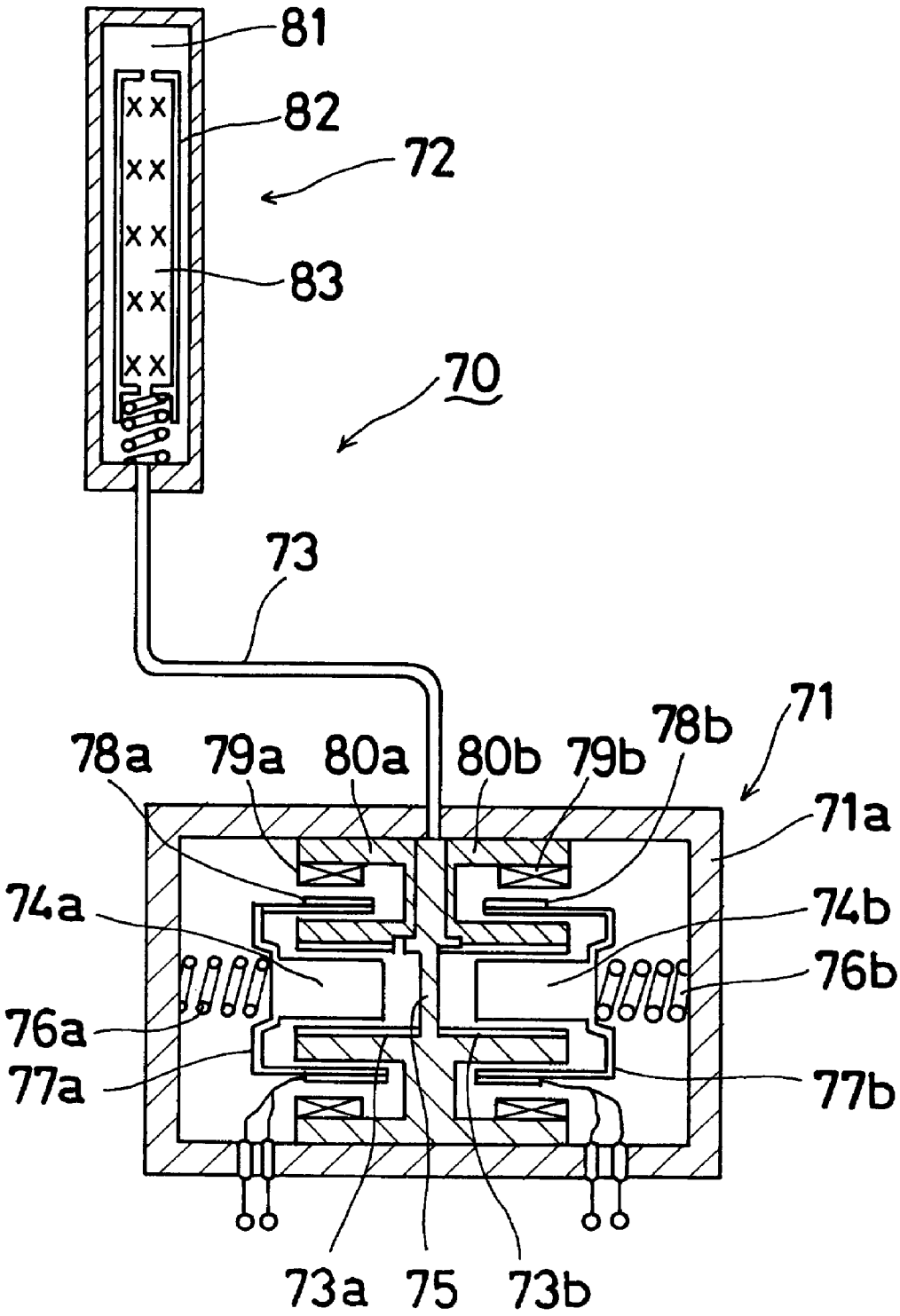
Fig. 4 PRIOR ART
FIG. 4 is a view showing a linear compressor of the related art.

In FIG. 3, a Stirling refrigerator 200 is made up of a linear compressor 1, a refrigerating part 50 and a conduit 60 connecting the linear compressor 1 and the refrigerating part 50. The construction of the linear compressor 1 is the same as in the first preferred embodiment and therefore will not be described here.

The refrigerating part 50 is made up of a housing 51 and a displacer 52 which is received inside the housing 51 and reciprocates in the direction of its axis L2. The displacer 52 has its inside filled with a cold storage material. A refrigerating side compression chamber 53 is formed by the displacer 52 and the bottom 51*a* of the housing 51. An expansion chamber 54 is formed by the displacer 52 and the top 51*b* of the housing 51. The refrigerating part side compression chamber 53 and the working gas passages 17 are connected by the conduit 60. The displacer 52 is supported from the top 51*b* of the housing 51 by a spring (not shown).

In a Stirling refrigerator of the construction described above, when an alternating current is passed through the moving coils 4*a*, 4*b*, the first piston 7*a* and the second piston 7*b* reciprocate in opposite directions inside the first cylinder part 11*a* and the second cylinder part 11*b* along the axis L1 and impart a sine wave motion to the gas pressure inside the compression chamber 16. This pressure fluctuation is transmitted through the multiple working gas passages 17 and the conduit 60 to the refrigerating part side compression chamber 53. Under this pressure fluctuation, the displacer 52 reciprocates inside the housing 51, but at this time, according to the mass of the displacer 52 and the natural oscillation frequency of the spring (not shown) supporting the displacer 52, the displacer 52 reciprocates inside the housing 51 with a fixed phase difference with respect to the pressure fluctuation. When this phase difference is suitably adjusted, the working gas inside the expansion chamber 54 absorbs heat and has a cooling effect, and consequently a low temperature can be obtained at the expansion chamber 54. Because the refrigerating part side compression chamber 53 and the expansion chamber 54 are connected by way of voids in the cold storage material inside the displacer 52, working gas having absorbed heat in the expansion chamber 54 displaces to the side of the cold storage material in the displacer 52 and in this position releases heat. That is, there is an action like heat being pumped from the expansion chamber 54 toward the cold storage material on the side near the working gas passages 17, and a cooling effect is produced at the expansion chamber 54.

In this second preferred embodiment, because a linear compressor like that shown in the first preferred embodiment is used as a pressure fluctuation source of a Stirling refrigerator, the refrigerating efficiency is extremely high and very economical operation is possible.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A linear compressor with a coaxial piston arrangement comprising:

a cylinder member having a first cylinder part and a second cylinder part disposed coaxially with the first cylinder part;

a first piston reciprocatably disposed inside the first cylinder part;

a second piston reciprocatably disposed inside the second cylinder part and disposed coaxially with the first piston;

a compression chamber defined between the first piston and the second piston;

a plurality of working gas passages having end openings respectively via which the working gas enters into the compression chamber from the working gas passages and exhausts from the compression chamber to the working gas passages;

wherein said working gas passages are arranged to line up in a direction perpendicular to the axial direction of the first and second cylinder parts.

2. A linear compressor with a coaxial piston arrangement as set forth in claim 1, further comprising:

heat-radiating means provided around the working gas passages.

3. A linear compressor with a coaxial arrangement as set forth in claim 1, wherein the cylinder member is made of an aluminum or an aluminum alloy.

* * * * *